United States Patent [19]

Wykes et al.

[11] 4,242,892

[45] Jan. 6, 1981

[54] LAYING HEAD WITH SEGMENTED LAYING PIPE

[75] Inventors: Robert D. Wykes, Worcester; Harold E. Woodrow, Northboro, both of Mass.

[73] Assignee: Morgan Construction Company, Worcester, Mass.

[21] Appl. No.: 33,451

[22] Filed: Apr. 26, 1979

[51] Int. Cl.[3] ..... B21D 11/00

[52] U.S. Cl. ..... 72/66; 140/2; 193/2 R; 242/82

[58] Field of Search ..... 72/66; 140/2; 242/82; 193/2 R, 38; 302/64; 138/155

[56] References Cited

U.S. PATENT DOCUMENTS

| | | | |
|---|---|---|---|
| 3,395,560 | 8/1968 | Cofer et al. | 72/66 |
| 3,452,785 | 7/1969 | Melear et al. | 72/66 |
| 3,469,429 | 9/1969 | Dopper et al. | 72/66 X |
| 3,873,040 | 3/1975 | Searin et al. | 242/82 |
| 4,074,553 | 2/1978 | Woodrow | 72/66 |
| 4,189,106 | 2/1980 | Weis | 242/82 |

*Primary Examiner*—Leon Gilden

*Attorney, Agent, or Firm*—Thompson, Birch, Gauthier & Samuels

[57] ABSTRACT

A laying head is disclosed for forming the longitudinally moving hot rolled product of a rolling mill into a helix. The laying head includes a housing carrying a cone assembly for rotation about an axis. The cone assembly has a support member with a three dimensional configuration curving around said axis. A plurality of clamp members are fixed to the support member at spaced locations along the length thereof. A plurality of discrete tubular guides are removably retained by the clamp members at operative positions collectively defining a guide path which is parallel to the curvature of the support member. Means are provided for receiving the product along said axis and for delivering the product into the first of the guides. Means are also provided for rotating the cone assembly, whereupon passage of the product along the guide path will result in the product exiting from the laying head in the form of a helix.

10 Claims, 7 Drawing Figures

LAYING HEAD WITH SEGMENTED LAYING PIPE

TECHNICAL FIELD

This invention relates generally to rolling mills of the type which produce hot rolled products such as rods, and is concerned in particular with an improved laying head for forming such products into helixes which are then either collected directly in coil form, or deposited in overlapping loops on moving treatment conveyors.

BACKGROUND OF THE PRIOR ART

Conventional rolling mill laying heads employ three dimensional laying pipes which are formed by bending a straight length of pipe at high temperature around a forming fixture. The pipe is then allowed to cool, is cut, and has various locating blocks and bellmouths welded to it. It is then attached to a rotatable laying cone for operation.

In a modern high speed rod mill, laying heads must handle product at elevated tempertures in the range of 1600° F. moving at speeds in excess of 10,000 f.p.m. Under such conditions, the laying pipes are subjected to severe wear, necessitating their frequent replacement. The form and accuracy of such laying pipes is critical. Pipes formed incorrectly, or which through age relieving or abuse become malformed, can cause serious problems in operation.

In the past, attempts have been made at prolonging the useful life of laying pipes by providing them with replaceable inserts. Such arrangements, as shown for example in U.S. Pat. No. 4,074,553, have not proven successful, due primarily to the difficulty of replacing worn inserts.

BRIEF SUMMARY OF THE PRESENT INVENTION

The present invention avoids the problems mentioned above by replacing the conventional fabricated laying pipe with a segmented design made up of discrete short tubular guides. Each guide is detachably held in place by a clamp member fixed to a three dimensional support forming part of the rotatable laying cone. The guides are preferably dimensionally identical, thus making it possible to interchangeably mount them anywhere along the curved guide path.

In one embodiment of the present invention, the guide members are straight and can thus be rotated to present unworn surfaces to the product. In another embodiment, the guide members are curved and span a plurality of clamp members. Furthermore, those guide members which show a greater tendency to wear can be made of higher priced wear-resistant materials, while the remainder of the guide members can be made of less expensive materials.

DESCRIPTION OF PREFERRED EMBODIMENT

Figure 1:
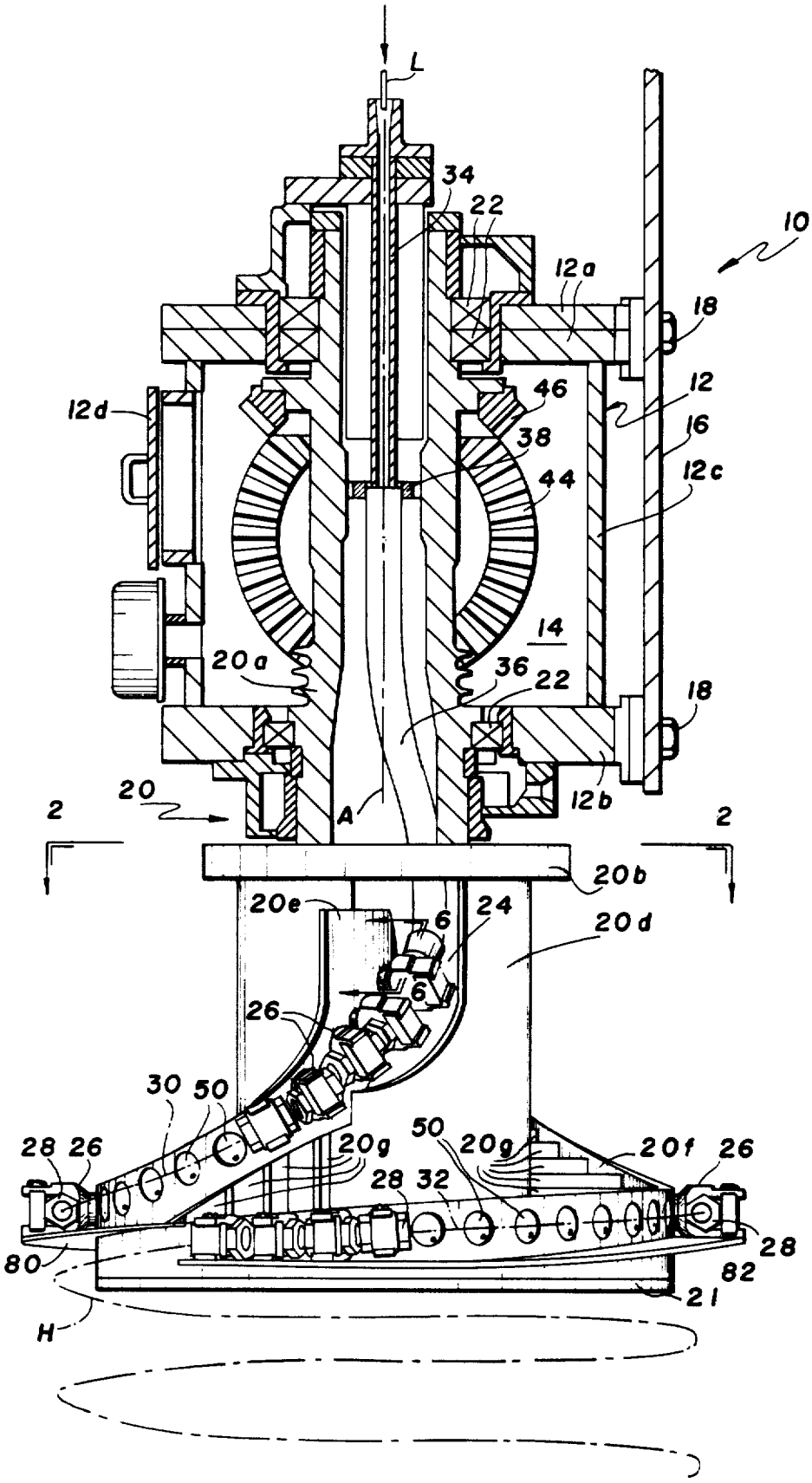
FIG. 1 is a vertical sectional view taken through a laying head embodying the concepts of the present invention.
Figure 2:
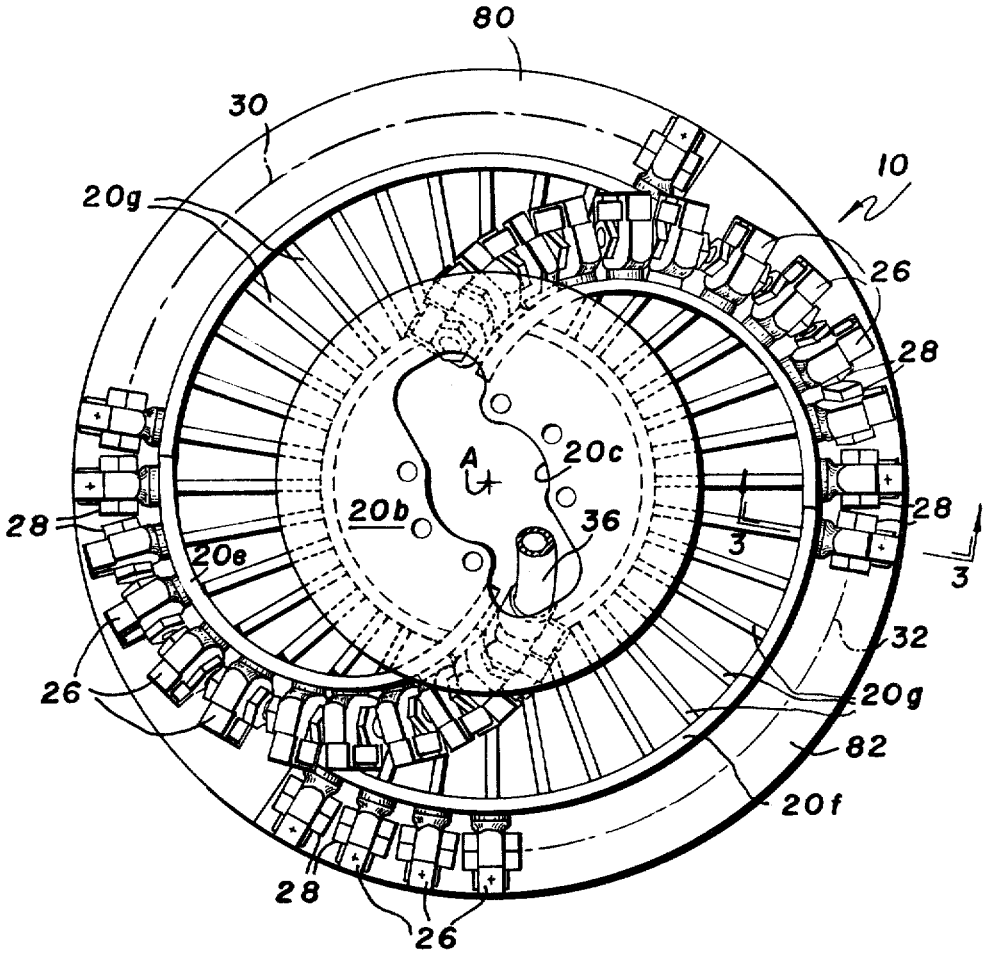
FIG. 2 is a horizontal sectional view taken along lines 2—2 of FIG. 1.
Figure 4:
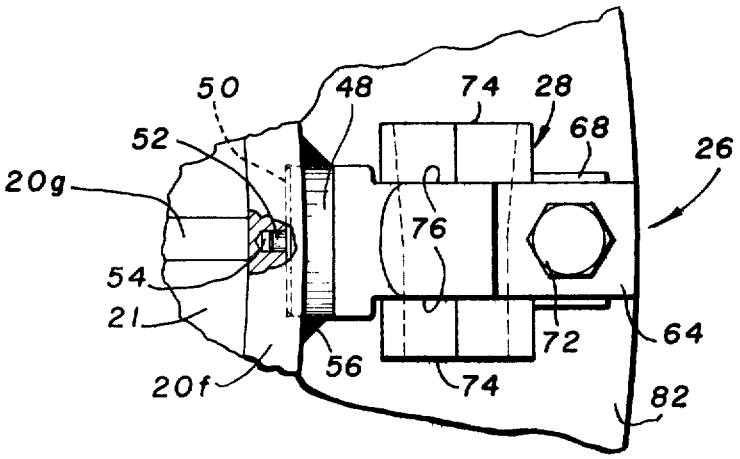
FIGS. 4 and 5 are side and top views of an individual guide and clamp assembly taken respectively on lines 4—4 and 5—5 of FIG. 3.
Figure 3:
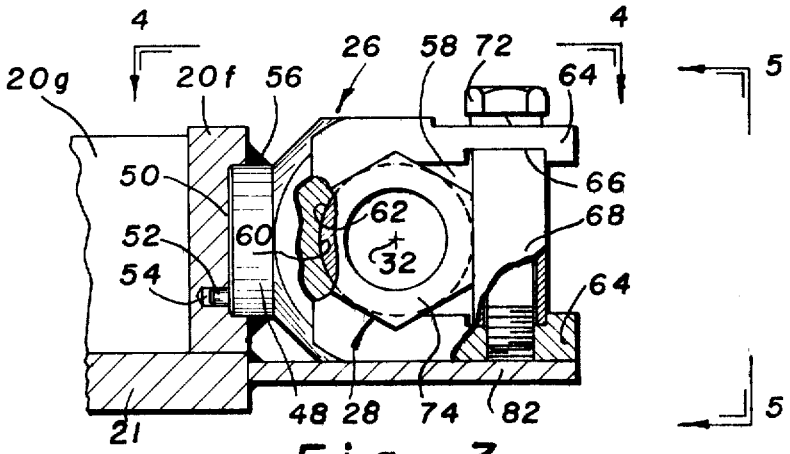
FIG. 3 is an enlarged sectional view taken along lines 3—3 of FIG. 2.

Referring initially to FIGS. 1 and 2, a laying head 10 is shown comprising a housing 12 including top and bottom plates **12*a*, 12*b* and a side wall 12*c* with an access door 12*d* leading to the housing interior 14. The housing is connected to a support member 16 by any convenient means such as for example bolts 18**.

A cone assembly generally indicated at 20 is supported by the housing 12 for rotation about an axis "A". The cone assembly includes a sleeve **20*a* rotatably journalled by means of bearings 22 in the top and bottom housing plates 12*a*, 12*b*. The bottom end of the sleeve 20*a* is fixed to a circular plate 20*b* having an opening 20*c* therein connecting the sleeve interior with the interior of a depending cylindrical drum 20*d*, also fixed to the plate 20*b*. The bottom of the drum 20*d* is closed by a bottom plate 21**.

The cone assembly 20 also includes at least one and preferably two support members **20*e* and 20*f* which are each provided with a three dimensional configuration curving around the rotational axis A of the cone assembly 20. Each support member 20*e*, 20*f* is supported by means of structural webs 20*g* extending radially from the cylindrical drum 20*d*. The upper ends of the curved support members 20*e*, 20*f* are located adjacent to opposed openings in the drum 20*d*, only one such opening being shown at 24 in FIG. 1**.

A plurality of clamp members generally indicated at 26 are fixed to each support member at spaced locations along the length thereof. In one embodiment of the invention as shown in FIGS. 1–5, a plurality of discrete tubular guides 28 are removably retained by the clamp members 26 at operative positions collectively defining a pair of delivery guide paths 30 and 32, only one of which will be in use at any given time. Delivery guide path 30 is parallel to the curvature of support member **20*e*, and delivery guide path 32 is likewise parallel to the curvature of support member 20*f***.

Figure 6:
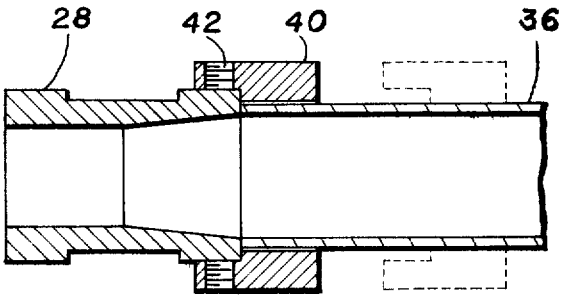
FIG. 6 is a sectional view on an enlarged scale taken on line 6—6 of FIG. 1 showing the means for detachably connecting the delivery end of the curved section of the receiving pipe to the first tubular guide of a given guide path.
Figure 5:
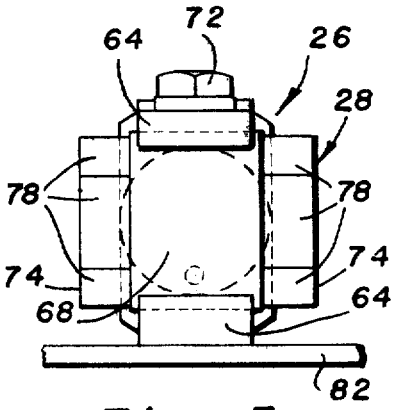

A receiving means is provided for receiving a length "L" of hot rolled product moving along axis A, and for delivering the product to the first guide 28 of either guide path 30 or guide path 32. Preferably, the receiving means will consist of a straight small diameter pipe section 34 leading to a curved larger diameter pipe section 36. Although the pipe section 36 is shown as a single continuous length, it could also comprise a series of shorter guides similar to the guides 28. The upper end of pipe section 36 is rotatably supported in a collar 38 located within the bore of sleeve **20*a*. As is best shown in FIG. 6, the delivery end of pipe section 36 is detachably secured to the first tubular guide 28 of either guide path 30 or 32 by means of a collar 40 and set screw 42. When the curved pipe section 36 is to be rotated about axis A from a position communicating with guide path 30 (as shown in FIGS. 1 and 2) to a position communicating with the other guide path 32, the set screw 42 is first loosened and the collar 40 slid along pipe 36 to a position as indicated in dotted in FIG. 6. Thereafter, the pipe section 36 is rotated in the upper collar 38 about axis A to a position communicating with the first guide 28 of guide path 32. The collar 40 is then slid back into place and the set screw 42** tightened.

The cone assembly 20 is rotated about axis A by a conventional laying head drive (not shown) acting through a bevel gear 44 in meshed relationship with a bevel gear 46 carried on the sleeve 20*a*. By rotating the cone assembly 20 at an appropriate speed, the product L exiting from the laying head 10 after passing through receiving pipe sections 34, 36 and along either guide path 30 or 32 will be formed into a helix indicated schematically at "H" in FIG. 1.

The discrete tubular guides 28 are preferably dimensionally identical, thus permitting them to be interchangeably mounted along either guide path 30 or 32. Where extreme wearing is experienced at certain locations along the guide paths, some of the guides can be fabricated of more expensive wear-resistant materials, while the remaining guides can be fabricated of less expensive materials.

The clamp members 26 are also preferably identically dimensioned and constructed. As can best be seen by additional reference to FIGS. 3–5, each guide member 26 has a cylindrical base 48 received in a "first" circular blind hole (see also FIG. 1) in the appropriate support member 20*e*, 20*f*. Each base 48 is further provided with a protruding pin 52 received in a "second" locating hole 54 in the bottom of the hole 50. The relative alignment of the clamp members 26 along the support members 20*e*, 20*f* is thus governed by the positions of the blind holes 50 which receive the clamp bases 48 and the locating holes 54 which receive the pins 52. The clamp members 26 may be fixed in place by any convenient means, preferably by welding as at 56.

The clamp members 26 have guide receiving notches 58 with semi-cylindrical bases 60. The guides 28 have cylindrical external walls 62 dimensioned to seat snugly in the notches 58 against the bases 60.

The guides 28 are retained in their operative positions by means including ears 64 on the clamp members. The ears 64 are located on opposite sides of the notches 58, and their upper ends are grooved as at 66 to receive the ends of keeper plates 68. The keeper plates 68 bridge the gap between the ears 64 and are held in place by bolts 72. Each bolt 72 extends through one ear 64 and is threaded in the other ear 64. The keeper plates 68 exert a retaining force on the guides tending to seat their external cylindrical walls 62 in the bases 60 of the notches 58.

The guides 28 are preferably provided with enlarged diameter shoulders 74 at opposite ends of their cylindrical external walls 62. These shoulders are confined between opposite sides of the clamp ears 64 as at 76 (see FIG. 4), thereby providing a means of axially located the guides in their respective clamp notches.

Preferably, the guide shoulders 74 include flat faces 78 which cooperate in engagement with the keeper plates 68 to prevent rotation of the guides during operation of the laying heads. This arrangement also enables the guides to be rotatably adjusted to make better use of their internal guide surfaces.

Deflector plates 80, 82 insure that product exiting from either guide path 30 or 32 is deflected downwardly in helix form.

Figure 7:
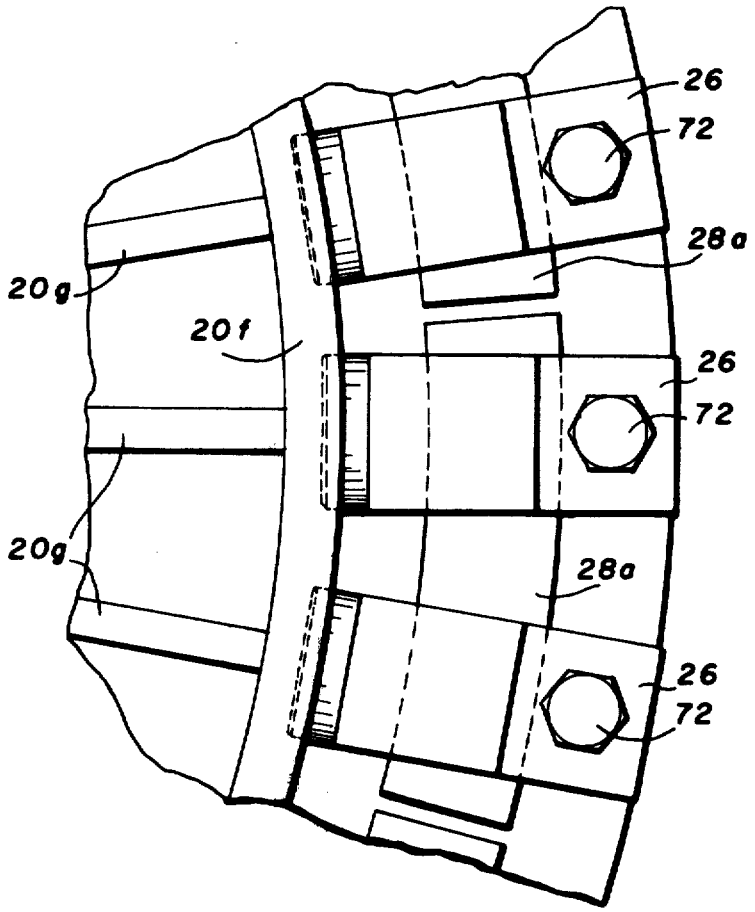
FIG. 7 is a view similar to FIG. 4 showing an alternate embodiment of the invention employing curved guide members.

FIG. 7 shows an alternate embodiment of the invention where the individual guides 28*a* comprise short curved tubular elements, each being supported by two of the clamp members 26.

In light of the foregoing, it will now be appreciated that the present invention provides a number of significant advantages not offered by prior art devices. The use of easily replaceable discrete tubular guides eliminates the time, expenditures and operational uncertainties associated with conventional replacement pipe fabricating techniques. The individual guides are detachably mounted yet securely fixed in place in their respective clamp members. Axial guide shifting is effectively prevented, thereby enabling the guides to be spaced one from the other along the guide path. This allows freedom for thermal expansion and contraction, and thus eliminates distortions of the guide path.

The use of discrete tubular guides also facilitates the employment of more expensive wear-resistant guide materials at selected locations along the guide path, where frictional engagement between the product and guide surfaces is higher.

We claim:

1. In a rolling mill, a laying head for forming a longitudinally moving hot rolled product length into a helix, comprising: a housing; a cone assembly journalled in said housing for rotation about an axis, said cone assembly having a support member with a three dimensional configuration curing around said axis; a plurality of clamp members fixed to said support member at spaced locations along the length thereof; a plurality of discrete tubular guides, said guides being removably retained by said clamp members at operative positions collectively defining a guide path which is parallel to the curvature of said support member; means for receiving said product length along said axis and for delivering said product length into the first of said guides; and, means for rotating said cone assembly, whereupon passage of the product length along said guide path will result in said product length exiting from said laying head in the form of a helix.

2. The laying head of claim 1 wherein said tubular guides are dimensionally identical, thus permitting said guides to be interchangeably mounted along said guide path.

3. The laying head of claims 1 or 2 wherein said tubular guides are fabricated of different materials, with some of said guides being more resistant of frictional wear than others.

4. The laying head of claim 1 wherein said clamp members are identical, each clamp member having a cylindrical base received in a first circular blind hole in said support member, each base being further provided with a protruding pin received in a second locating hole in the bottom of each first blind hole, the relative alignment of said clamp members along said support member being governed by the positions of said blind holes and said locating holes.

5. The laying head of claim 4 wherein said clamp members are fixed to said support member by welding.

6. The laying head of claim 1 wherein said clamp members have guide receiving notches with semi-cylindrical bases, said guides having cylindrical external walls dimensioned to seat snugly in said notches against said bases, and retaining means for removably retaining said guides in said notches.

7. The laying head of claim 6 wherein said retaining means includes ears on said clamp members on opposite sides of said notches, and keeper plates detachably secured in operative positions bridging the gaps between said ears, said keeper plates being in contact with said guides to exert a retaining force thereon tending to seat said cylindrical external walls in said notches.

8. The laying head of claim 7 wherein said keeper plates are detachably secured in said operative positions by means including bolt members extending through passageways in said keeper plates and aligned apertures in said ears.

9. The laying head of claim 7 wherein said guides are additionally provided with enlarged diameter shoulders at opposite ends of said cylindrical external walls, said guides being axially located in said notches by the engagement of said shoulders with the opposite sides of said ears.

10. The laying head of claim 9 wherein said shoulders are provided with flat faces which cooperate in engagement with said keeper plates to prevent rotation of said guides in said notches.

* * * * *